US009214085B2

(12) United States Patent
Ichihara

(10) Patent No.: US 9,214,085 B2
(45) Date of Patent: Dec. 15, 2015

(54) VEHICLE GATEWAY DEVICE

(75) Inventor: Masaaki Ichihara, Gifu (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 64 days.

(21) Appl. No.: 13/502,049

(22) PCT Filed: Nov. 6, 2009

(86) PCT No.: PCT/JP2009/068984
§ 371 (c)(1),
(2), (4) Date: Apr. 13, 2012

(87) PCT Pub. No.: WO2011/055447
PCT Pub. Date: May 12, 2011

(65) Prior Publication Data

US 2012/0204166 A1 Aug. 9, 2012

(51) Int. Cl.
*G08G 1/0967* (2006.01)

(52) U.S. Cl.
CPC ..... *G08G 1/096716* (2013.01); *G08G 1/09675* (2013.01); *G08G 1/096775* (2013.01)

(58) Field of Classification Search
None
See application file for complete search history.

(56) References Cited

U.S. PATENT DOCUMENTS

| | | | | |
|---|---|---|---|---|
| 8,458,689 | B2 * | 6/2013 | Barman et al. | 717/170 |
| 2002/0174360 | A1 | 11/2002 | Ikeda | |
| 2003/0147534 | A1 * | 8/2003 | Ablay et al. | 380/270 |
| 2005/0090941 | A1 * | 4/2005 | Stefan et al. | 701/1 |
| 2005/0144616 | A1 * | 6/2005 | Hammond et al. | 717/173 |
| 2005/0216903 | A1 * | 9/2005 | Schaefer | 717/168 |
| 2005/0256614 | A1 * | 11/2005 | Habermas | 701/1 |
| 2005/0262498 | A1 * | 11/2005 | Ferguson et al. | 717/172 |
| 2007/0112773 | A1 * | 5/2007 | Joyce | 707/9 |
| 2008/0005733 | A1 * | 1/2008 | Ramachandran et al. | 717/168 |
| 2008/0219274 | A1 * | 9/2008 | Kato et al. | 370/401 |

(Continued)

FOREIGN PATENT DOCUMENTS

| | | | |
|---|---|---|---|
| DE | 10193054 | T1 | 11/2002 |
| DE | 102004040627 | A1 | 2/2006 |

(Continued)

OTHER PUBLICATIONS

Nilsson et al. "A framework for self-verification of firmware updates over the air in vehicle ECUs." GLOBECOM Workshops, 2008 IEEE. IEEE, 2008. Retrieved on [Jul. 16, 2015] Retrieved from the Internet: URL<http://ieeexplore.ieee.org/stamp/stamp.jsp?tp=&arnumber=4746641>.*

(Continued)

*Primary Examiner* — Thuy Dao
*Assistant Examiner* — Cheneca Smith
(74) *Attorney, Agent, or Firm* — Kenyon & Kenyon LLP

(57) ABSTRACT

A vehicle gateway device is provided in a vehicle and can update information acquired by communication with outside the vehicle. The vehicle gateway device determines whether the update information acquired by communication with outside the vehicle is information for a vehicle system related to vehicle control, records and manages the update information when it is determined that the update information is information for the vehicle system, and transmits the update information to an information processing unit when it is determined that the update information is not information for the vehicle system. In this way, a recording medium with low memory capacity can be used to update information and information update management can be simplified.

1 Claim, 2 Drawing Sheets

(56) References Cited

U.S. PATENT DOCUMENTS

| | | | | |
|---|---|---|---|---|
| 2009/0055525 | A1* | 2/2009 | Slepov et al. | 709/224 |
| 2009/0119657 | A1* | 5/2009 | Link, II | 717/171 |
| 2009/0300595 | A1* | 12/2009 | Moran et al. | 717/170 |
| 2011/0083128 | A1* | 4/2011 | Hoch et al. | 717/174 |

FOREIGN PATENT DOCUMENTS

| | | | |
|---|---|---|---|
| JP | 2003-101552 | A | 4/2003 |
| JP | 2004-109061 | A | 4/2004 |
| JP | 2005-078324 | A | 3/2005 |
| JP | 2005-349878 | A | 12/2005 |

OTHER PUBLICATIONS

Shavit et al. Firmware update over the air (FOTA) for automotive industry. No. 2007-01-3523. SAE Technical Paper, 2007. Retrieved on [Jun. 23, 2015] Retrieved from the Internet: URL<http://scl.hanyang.ac.kr/scl/database/papers/APAC/2007/data/papers/2007-01-3523.pdf>.*

International Search Report mailed Dec. 1, 2009 of PCT/JP2009/068984.

Translation of International Preliminary Report on Patentability mailed Jun. 14, 2012 of PCT/JP2009/068984.

* cited by examiner

VEHICLE GATEWAY DEVICE

This is a 371 national phase application of PCT/JP2009/068984 filed 6 Nov. 2009, the contents of which are incorporated herein by reference.

TECHNICAL FIELD

The present invention relates to a vehicle gateway device that is provided in a vehicle and serves as an information gateway.

BACKGROUND ART

As an information gateway (network connection) provided in the vehicle, for example, Japanese Unexamined Patent Application Publication No. 2003-101552 discloses a system which receives information transmitted from an information center using an in-vehicle gateway and transmits information from the in-vehicle gateway through a control system LAN or a body system LAN of the vehicle.

In the system, when vehicle information, such as software, is updated, the in-vehicle gateway stores update information and manages the update of the update information.

CITATION LIST

Patent Literature

[Patent Literature 1] Japanese Unexamined Patent Application Publication No. 2003-101552

SUMMARY OF INVENTION

Technical Problem

However, in this kind of system, it is necessary to provide a recording medium with high capacity in the in-vehicle gateway. As a result, software update management becomes complicated. For example, when the in-vehicle gateway updates information for a vehicle system related to, for example, the control of the traveling, braking, and steering of the vehicle and information for an information system related to multimedia, the recording medium required to update information needs to have high capacity in order to respond to the update of the information. In addition, since the version of multimedia software is frequently updated, information update management in the in-vehicle gateway becomes complicated.

The invention has been made in order to solve the above-mentioned problems and an object of the invention is to provide a vehicle gateway device that updates information smoothly while preventing an increase in the memory capacity of a gateway.

Solution to Problem

That is, according to an aspect of the invention, there is provided a vehicle gateway device that is provided in a vehicle and can update information acquired by communication with outside the vehicle. The vehicle gateway device includes: determining means for determining whether the information acquired by communication with outside the vehicle is information for a vehicle system related to vehicle control; information recording and management means for recording and managing the information when the determining means determines that the information acquired by communication with outside the vehicle is the information for the vehicle system; and transmitting means for transmitting the information to an information processing unit when the determining means determines that the information acquired by communication with outside the vehicle is not the information for the vehicle system.

According to the invention, when information is information for the vehicle system, it is recorded and managed by the information recording means. When information is not information for the vehicle system, the information is transmitted to the information processing unit such that the information processing unit records and manages the information. In this way, it is possible to reduce the amount of update information recorded and managed by the gateway device. Therefore, in the gateway device, a recording medium with low memory capacity can be used to update information. In addition, since the gateway device records and manages only the update information for the vehicle system, information update management is simplified. Therefore, it is possible to update information smoothly while preventing an increase in the memory capacity of a gateway.

In the vehicle gateway device according to the above-mentioned aspect of the invention, the vehicle gateway device may connect three networks including an information system network, a vehicle system network, and a vehicle external communication network. The determining means may determine whether the information acquired by communication with outside the vehicle is information for the vehicle system related to the vehicle control and determine whether the information acquired by communication with outside the vehicle is information for an information system related to information processing. When the determining means determines that the information is information for the information system, the transmitting means may transmit the information to an information processing unit of the information system network.

According to the invention, the vehicle gateway device connects three networks including the information system network, the vehicle system network, and the vehicle external communication network and determines whether the information acquired by communication with outside the vehicle is information for the information system related to information processing. When it is determined that the information is information for the information system, the vehicle gateway device transmits the information to the information processing unit of the information system network such that the information processing unit records and manages the information. In this way, it is possible to reduce the amount of update information recorded and managed by the gateway device. Therefore, in the gateway device, a recording medium with low memory capacity can be used to update information. In addition, since the gateway device records and manages only the update information for the vehicle system, information update management is simplified. Therefore, it is possible to update information smoothly while preventing an increase in the memory capacity of a gateway.

In the vehicle gateway device according to the above-mentioned aspect of the invention, when the determining means determines that the information acquired by communication with outside the vehicle is not information for the vehicle system, the transmitting means may transmit the information to second external information recording and management means for recording and managing the update of the information through the information processing unit.

Advantageous Effects of Invention

According to the invention, it is possible to update information smoothly while preventing an increase in the memory capacity of a gateway device.

REFERENCE SIGNS LIST

Figure 1:
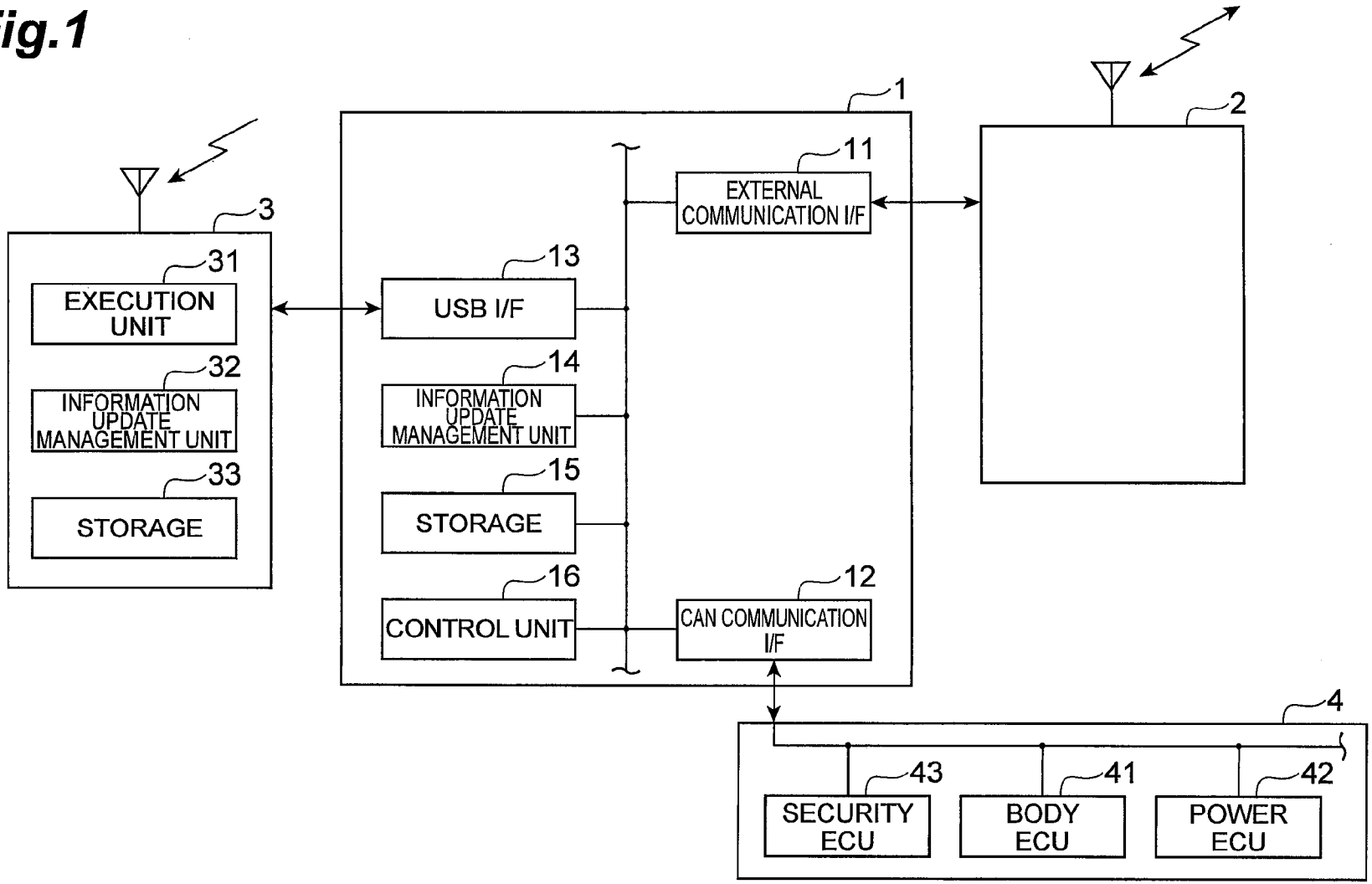
FIG. 1 is a schematic diagram illustrating the structure of a gateway device according to an embodiment of the invention.

1: GATEWAY DEVICE
2: VEHICLE EXTERNAL COMMUNICATION UNIT
3: NAVIGATION DEVICE
4: VEHICLE CONTROL UNIT

DESCRIPTION OF EMBODIMENTS

Hereinafter, an exemplary embodiment of the invention will be described in detail with reference to the accompanying drawings. In the description of the drawings, the same components are denoted by the same reference numerals and the description thereof will not be repeated.

FIG. 1 is a diagram illustrating the schematic structure of a gateway device according to this embodiment.

As shown in FIG. 1, a gateway device 1 according to this embodiment is a vehicle gateway device which is provided in the vehicle and connects three networks, that is, a network for communication with outside the vehicle, a vehicle information system network, and a vehicle control system network.

The gateway device 1 is connected to a vehicle external communication unit 2, a navigation device 3, and a vehicle control unit 4. The vehicle external communication unit 2 functions as vehicle external communication means for communication with outside the vehicle through, for example, a wireless communication medium and includes, for example, a transmitting/receiving antenna and a communication module. The vehicle external communication unit 2 may use any communication method, such as PLC, as long as it can perform information data communication with outside the vehicle. The vehicle external communication unit 2 communicates with the outside to transmit and receive information data. For example, the vehicle external communication unit 2 communicates with a management information center to receive update data for the information used in the vehicle and transmit the update data to the gateway device 1.

The navigation device 3 is for vehicle route guidance, includes, for example, a GPS (Global Positioning System) function, and performs vehicle route guidance using map data. As the navigation device 3, a device which is operated by the introduction of navigation software is used. In this case, the navigation device 3 can acquire an upgraded version of the navigation software through the vehicle external communication unit 2 and update information. The navigation device 3 functions as an information system network in the vehicle and acquires the upgraded version of the navigation software as the update information. In this case, the navigation device 3 functions as an information processing unit which updates information for the information system.

In addition, the navigation device 3 includes a navigation execution unit 31. The navigation execution unit 31 performs vehicle route guidance in response to, for example, a destination input operation. In addition, the navigation device 3 includes an information update management unit 32 and an information update storage 33. The information update management unit 32 manages the version of the update information for the information system transmitted from the gateway device 1 and functions as second information recording and management means for managing the update of information. The information update storage 33 is a memory which temporarily stores update information data for the information system transmitted from the gateway device 1.

It is preferable that the navigation device 3 include a monitor and a speaker capable of reproducing music or video, in addition to performing the vehicle route guidance.

The vehicle control unit 4 controls the operation of the vehicle, such as the traveling, braking, and steering of the vehicle, and performs control related to the traveling or operation of the vehicle, such as the control of devices provided in the body of the vehicle. For example, the vehicle control unit 4 is connected to the gateway device 1 such that it can perform CAN (Controller Area Network) communication with the gateway device 1.

The vehicle control unit 4 includes a body ECU (Electronic Control Unit) 41, a power ECU 42, and various control units related to, for example, the traveling of the vehicle. In addition, the vehicle control unit 4 includes a security ECU 43. The security ECU 43 has, for example, a function of transmitting an alarm signal to the center when detecting a vehicle theft. The ECUs of the vehicle control unit 4 can acquire the updated software transmitted from the gateway device 1.

The gateway device 1 includes an external communication I/F (Interface) 11, a CAN communication I/F 12, and a USB I/F 13. The external communication I/F 11 communicates with the vehicle external communication unit 2. For example, the external communication I/F 11 communicates with the vehicle external communication unit 2 using a LAN. The CAN communication I/F 12 performs CAN communication with the vehicle control unit 4. The USB I/F 13 communicates with the navigation device 3. For example, the USB I/F 13 communicates with the navigation device 3 using a LAN.

The gateway device 1 includes an information update management unit 14 and an information update storage 15. The information update management unit 14 manages, for example, the version of the update information for the vehicle system transmitted from the vehicle external communication unit 2. The information update management unit 14 functions as information recording and management means. When the control unit 16 determines that information acquired through the vehicle external communication unit 2 is the update information for the vehicle system, the information update management unit 14 records and manages the update information. The information update storage 15 is a memory which temporarily stores update information data for the vehicle system.

In addition, the gateway device 1 includes a control unit 16. The control unit 16 controls the overall operation of the gateway device 1 and includes a computer including, for example, a CPU, a ROM, and a RAM as a main unit. The control unit 16 functions as determining means for determining whether information acquired through the vehicle external communication unit 2 is update information for the vehicle system related to vehicle control. In addition, the control unit 16 functions as transmitting means for transmitting the update information to the navigation device 3 when it is determined that the information acquired through the vehicle external communication unit 2 is not the update information of the vehicle system.

Next, the operation of the gateway device 1 according to this embodiment will be described.

Figure 2:
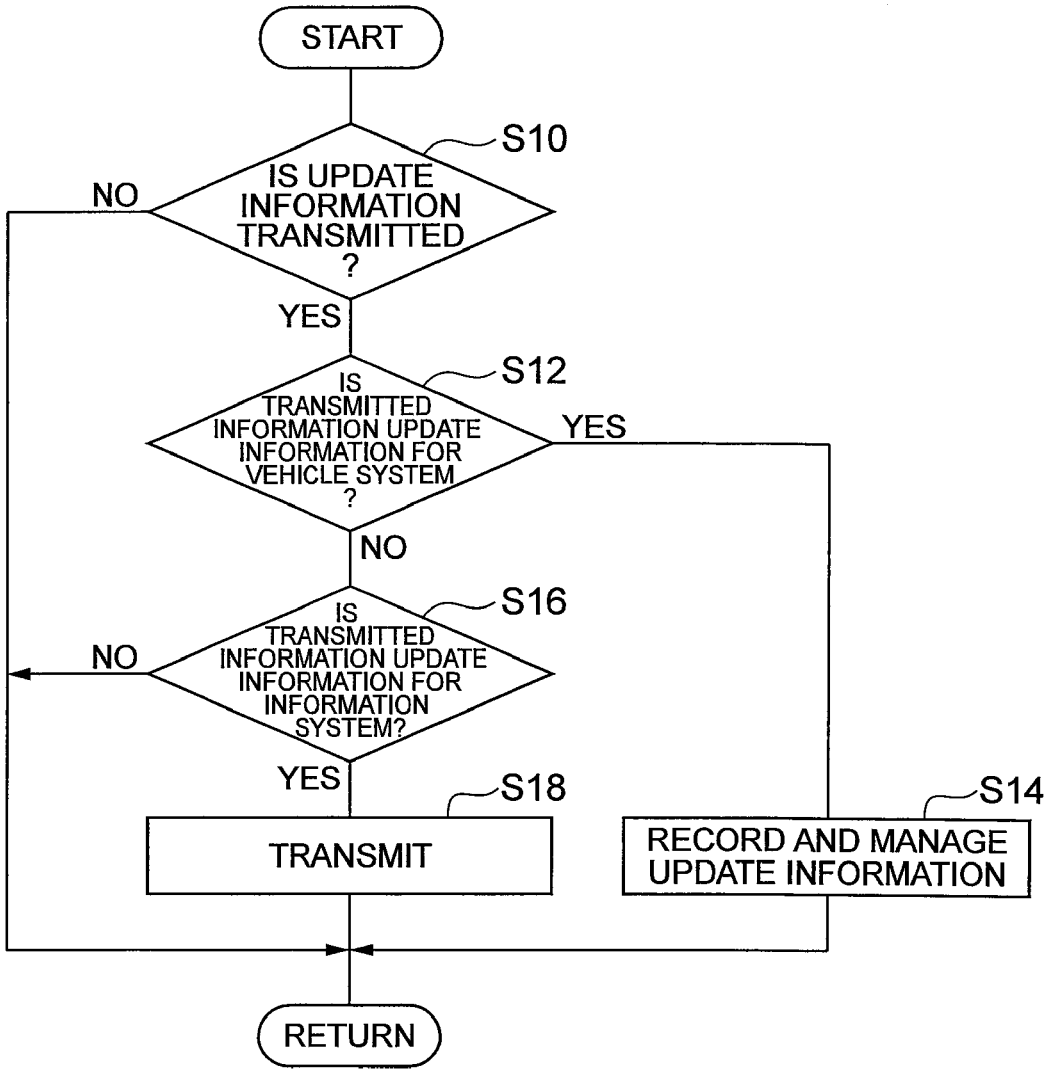
FIG. 2 is a flowchart illustrating the operation of the gateway device shown in FIG. 1.

FIG. 2 is a flowchart illustrating the operation of the gateway device 1 according to this embodiment. For example, the control process shown in FIG. 2 is repeatedly performed at a predetermined cycle by the gateway device 1.

First, as shown in S10 of FIG. 2, it is determined whether the update information is transmitted from the vehicle external communication unit 2. The vehicle external communication unit 2 transmits the update information, for example, when the user requests the transmission of the update information or when the update information is sent from the outside, for example, from the management center.

When it is determined in S10 that the update information is not transmitted from the vehicle external communication unit 2, the control process ends. On the other hand, when it is determined in S10 that the update information is transmitted from the vehicle external communication unit 2, it is determined whether the update information is information for the vehicle system (S12). For example, a list of the IDs of the information items of the vehicle system is set as a table to the control unit 16 in advance. When the ID of the currently acquired update information is identical to the ID of the ID list, it is determined that the update information is the information of the vehicle system. When the ID of the currently acquired update information is not identical to the ID of the ID list, it is determined that the update information is not information for the vehicle system.

When it is determined in S12 that the update information is information for the vehicle system, a process of managing and recording the update information is performed (S14). In the management and recording process, the gateway device 1 temporarily stores the update information for the vehicle system, records the update information for the vehicle system, and manages, for example, the version information for the update information.

On the other hand, when it is determined in S12 that the update information is not information for the vehicle system, it is determined that the update information is information for the information system (S16). For example, a list of the IDs of the information items of the information system is set as a table to the control unit 16 in advance. When the ID of the currently acquired update information is identical to the ID of the ID list of the information system, it is determined that the update information is information for the information system. When the ID of the currently acquired update information is not identical to an ID in the information system ID list, it is determined that the update information is not information for the information system.

When it is determined in S16 that the update information is not information for the information system, the control process ends. When it is determined in S16 that the update information is information for the information system, a transmission process is performed (S18). The transmission process transmits the update information for the information system to the navigation device 3. In this case, the navigation device 3 temporarily stores the transmitted update information for the information system, records the update information for the information system, and manages, for example, the version information for the update information. When the transmission process of S18 ends, the control process ends.

In the above-mentioned operation of the gateway device 1, the determination process of S16 in FIG. 2 may be omitted. For example, when it is determined in S12 that the update information is not information for the vehicle system, the update information may be determined to be information for the information system and the transmission process of S18 may be performed. In addition, it is determined in S10 in advance whether or not the destination of the update information is the navigation device from the address of the data only. When it is determined that the destination of the update information is not the navigation device, the determination process of S12 may be performed.

As described above, according to the vehicle gateway device 1 according to this embodiment, when the update information is information for the vehicle system, the gateway device 1 records and manages the update information. When the update information is not information for the vehicle system, the update information is transmitted to the navigation device 3 and the navigation device 3 records and manages the update information. In this way, it is possible to reduce the amount of update information recorded and managed by the gateway device 1. Therefore, in the gateway device 1, a recording medium with low memory capacity can be used to update information. In addition, since the gateway device 1 records and manages only the update information for the vehicle system, information update management is simplified. Therefore, information is updated smoothly while an increase in the memory capacity of the gateway device 1 is prevented.

The vehicle gateway device 1 according to this embodiment connects three networks, that is, the information system network, the vehicle system network, and the vehicle external communication network. The vehicle gateway device 1 determines whether the update information acquired by communication with outside the vehicle is information for the information system related to information processing. When it is determined that the update information is information for the information system, the vehicle gateway device 1 transmits the update information to an information processing unit in the information system network such that the information processing unit manages and records the update information. In this way, it is possible to reduce the amount of update information recorded and managed by the gateway device 1. Therefore, a recording medium with low memory capacity can be used to update information. In addition, since the gateway device 1 records and manages only the update information for the vehicle system, information update management is simplified. Therefore, information is updated smoothly while an increase in the memory capacity of the gateway device 1 is prevented.

As such, the update information for the vehicle system and the update information for the information system are separately stored and managed. In this way, it is very simple to manage, for example, the version of software. For example, information for the vehicle system is dependent on in-vehicle communication PF, hardware, and software. Therefore, it is managed whether the dependence is established (at the same time, whether a version upgrade is needed).

On the other hand, since the information for the information system of the navigation device 3 is dependent on hardware, OS, application software, and mutual interaction of application software, it is necessary to simultaneously check the hardware and software components whose versions need to be upgraded and perform detailed update management. In addition, in the network of the information system of the navigation device 3, in some cases, new application software is transmitted from the management center, causing an increase in the number of information items which need to be managed, and the dependence needs to be changed. In addition, the version is frequently updated in the navigation device 3. Therefore, when the gateway device 1 updates both information for the vehicle system and the information for the information system, a high-capacity memory is needed to store data and information management becomes complicated.

In contrast, the gateway device 1 according to this embodiment updates only information for the vehicle system and another information processing device, that is, the navigation device 3 updates the information for the information system. In this way, it is possible to update information smoothly while preventing an increase in the memory capacity of the gateway device 1. In addition, at that time, information that causes security problem is likely to be incorporated into the update information for the information system. Therefore, when the update information for the vehicle system and the update information for the information system are separately managed as in the invention, it is easy to prevent the update information for the vehicle system from being falsified.

INDUSTRIAL APPLICABILITY

According to the invention, it is possible to update information smoothly while preventing an increase in the memory capacity of the gateway device.

The invention claimed is:

1. A vehicle gateway system that is provided in a vehicle and can software update information acquired by communication with outside of the vehicle, comprising:

a first device including:

a central processing unit (CPU) programmed to determine whether the software update information acquired by communication with outside of the vehicle is information for a vehicle system including vehicle operation control of traveling, braking, or steering of the vehicle and determine whether the software update information is information for an information system when the software update information is not information for the vehicle system, an information recording and management device that stores a list of IDs of software update information items, records the information and manages the update of the software update information when the determining portion determines that an ID of the acquired software update information is identical to an ID of the list of IDs and that accordingly the software update information acquired by communication with outside of the vehicle is the information for the vehicle system;

a transmitting device that transmits the software update information when it is determined that the software update information acquired by communication with outside of the vehicle is information for the information system; and a second device including an information recording and management device that records the software update information transmitted by the transmitting device as information for the information system and manages the update of the software update information, wherein the first device connects three networks including an information system network, a vehicle system network, and a vehicle external communication network, and the second device is an information processing device including a navigation device that performs a vehicle route guidance.

* * * * *